US011577811B1

(12) United States Patent
Kurzynski et al.

(10) Patent No.: US 11,577,811 B1
(45) Date of Patent: Feb. 14, 2023

(54) LOCATION-BASED CONTROL OF EXHAUST SYSTEM FOR MARINE ENGINES

(71) Applicant: Brunswick Corporation, Mettawa, IL (US)

(72) Inventors: Adam Kurzynski, Neenah, WI (US); Jeffrey C. Etapa, Oakfield, WI (US)

(73) Assignee: Brunswick Corporation, Mettawa, IL (US)

( * ) Notice: Subject to any disclaimer, the term of this patent is extended or adjusted under 35 U.S.C. 154(b) by 835 days.

(21) Appl. No.: 16/528,135

(22) Filed: Jul. 31, 2019

(51) Int. Cl.

| | |
|---|---|
| ***B63H 21/34*** | (2006.01) |
| ***B63J 99/00*** | (2009.01) |
| ***F01N 13/08*** | (2010.01) |
| ***B63B 79/00*** | (2020.01) |

(52) U.S. Cl.
CPC ..... *B63H 21/34* (2013.01); *B63J 99/00* (2013.01); *F01N 13/087* (2013.01); *B63B 79/00* (2020.01)

(58) Field of Classification Search
CPC ..... B63H 21/34; B63J 99/00; F01N 13/087; B63B 79/00
See application file for complete search history.

(56) References Cited

U.S. PATENT DOCUMENTS

| | | | | |
|---|---|---|---|---|
| 3,967,446 | A | 7/1976 | Harralson et al. | |
| 4,668,199 | A | 5/1987 | Freund et al. | |
| 4,952,182 | A | 8/1990 | Curtis et al. | |
| 8,876,566 | B1 | 11/2014 | Hilbert et al. | |
| 9,051,041 | B2 | 6/2015 | Lookebill et al. | |
| 9,944,376 | B1 | 4/2018 | Waisanen et al. | |
| 2009/0171549 | A1* | 7/2009 | Hyde | F02D 41/1438 60/274 |
| 2020/0307578 | A1* | 10/2020 | Magolan | B60W 20/00 |

* cited by examiner

*Primary Examiner* — Stephen P Avila
(74) *Attorney, Agent, or Firm* — Andrus Intellectual Property Law, LLP

(57) ABSTRACT

A method of controlling an adjustable exhaust system for a marine engine includes receiving a vessel location of a marine vessel having an adjustable exhaust system and identifying a noise constraint based on the vessel location. A current exhaust mode of the adjustable exhaust system is identified. A determination is then made regarding whether the exhaust system is exceeding the noise constraint based on the current exhaust mode. If the noise constraint is exceeded, an instruction is generated to adjust the adjustable exhaust system to comply with the noise constraint.

20 Claims, 6 Drawing Sheets

LOCATION-BASED CONTROL OF EXHAUST SYSTEM FOR MARINE ENGINES

FIELD

The present disclosure generally relates to exhaust systems for marine engines, and more particularly to adjustable exhaust systems for marine engines that are controllable based on location in order to comply with local noise constraints.

BACKGROUND

The following U.S. Patents disclose additional state of the art. These patents are incorporated herein by reference, in entirety:

U.S. Pat. No. 9,944,376 discloses exhaust systems for outboard marine engines configured to propel a marine vessel in a body of water. An intermediate exhaust conduit is configured to receive the exhaust gas from the primary exhaust conduit. A primary muffler receives the exhaust gas from an intermediate exhaust conduit. A secondary muffler receives the exhaust gas from the primary muffler. An idle relief outlet discharges the exhaust gas from the secondary muffler to atmosphere. A bypass valve is positionable into an open position wherein the exhaust gas is permitted to bypass the secondary muffler and flow from the primary muffler to the idle relief outlet and into a closed position wherein the exhaust gas is not permitted to bypass the secondary muffler and instead flows from the primary muffler to the idle relief outlet via the secondary muffler.

U.S. Pat. No. 9,051,041 discloses a marine propulsion system for propelling a marine vessel in water. The system comprises an outboard motor that is coupled to a marine vessel. The system comprises an exhaust gas relief outlet that is located above the water when the outboard motor is operated at idle speed. A conduit conveys exhaust gas from the exhaust gas relief outlet to a discharge outlet located on the marine vessel.

U.S. Pat. No. 8,876,566 discloses a marine drive and marine exhaust pipe that include a main exhaust flow chamber and an auxiliary idle relief chamber. The auxiliary idle relief chamber vents exhaust above the surface of the body of water in which the vessel is operating.

U.S. Pat. No. 4,952,182 discloses an exhaust relief system for an outboard motor that includes an exhaust chamber into which exhaust is discharged from the engine. A first passage in communication with the exhaust chamber provides contraction of the exhaust as the exhaust passes rearwardly from which the exhaust is discharged into an expansion chamber which substantially surrounds the exhaust chamber. From the expansion chamber, the exhaust is routed through and contracted into a second passage in communication with the expansion chamber, after which it is discharged to atmosphere. The tortuous path provided by the exhaust relief system, along with the repeated expansion and contraction of the exhaust as it flows to atmosphere, provides a muffling effect at idle operation.

U.S. Pat. No. 4,668,199 discloses an exhaust system for an outboard motor that includes a main exhaust passageway extending through a partially water filled chamber in the drive shaft housing. An inlet idle relief passage connects the top of the chamber with the main exhaust passageway and an outlet passage connects the top of the chamber with the atmosphere.

U.S. Pat. No. 3,967,446 discloses a tuned exhaust gas relief system for marine propulsion systems, for example an outboard motor, that includes a lower drive shaft housing coupled to a two stroke engine by a pair of intermediate stacked exhaust extension plates. The housing directs the exhaust gas downwardly to a through-the-hub exhaust propeller for exit there through. With the unit in reverse or idling, exhaust gases are trapped within the housing. A pair of tuned exhaust relief passageways may be formed by cavities in the mating faces of the two extension plates with a pair of inlet openings in the lower wall of the bottom plate. A baffle member may overlie the inlet openings. The passageways define constant cross-sectional area channels which terminate in exhaust openings in the rear wall of the drive shaft housing.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, a method of controlling an adjustable exhaust system for a marine engine includes receiving a vessel location of a marine vessel having an adjustable exhaust system and identifying a noise constraint based on the vessel location. A current exhaust mode of the adjustable exhaust system is identified. A determination is then made regarding whether the exhaust system is exceeding the noise constraint based on the current exhaust mode. If the noise constraint is exceeded, an instruction is generated to adjust the adjustable exhaust system to reduce the noise generated thereby in order to comply with the noise constraint. The instruction may be an alert notification instructing an operator to change the exhaust mode, or a control instruction to automatically change the exhaust mode.

In one embodiment, an exhaust system for a marine engine on a marine vessel includes a multi-stage exhaust system having a first exhaust stage portion and a second exhaust stage portion, and a bypass valve therebetween that controls the flow of exhaust gas between the first exhaust stage portion and the second exhaust stage portion. The system further includes an exhaust control module executable on a processor to receive a vessel location of the marine vessel from a location tracking system, and identify a noise constraint based on the vessel location. A current exhaust mode of the multi-stage adjustable exhaust system is identified, and then it is determined whether the adjustable exhaust system is exceeding the noise constraint based on the current exhaust mode. If so, then an instruction is generated to adjust the adjustable exhaust system to reduce the noise generated thereby.

DETAILED DESCRIPTION

Figure 1:
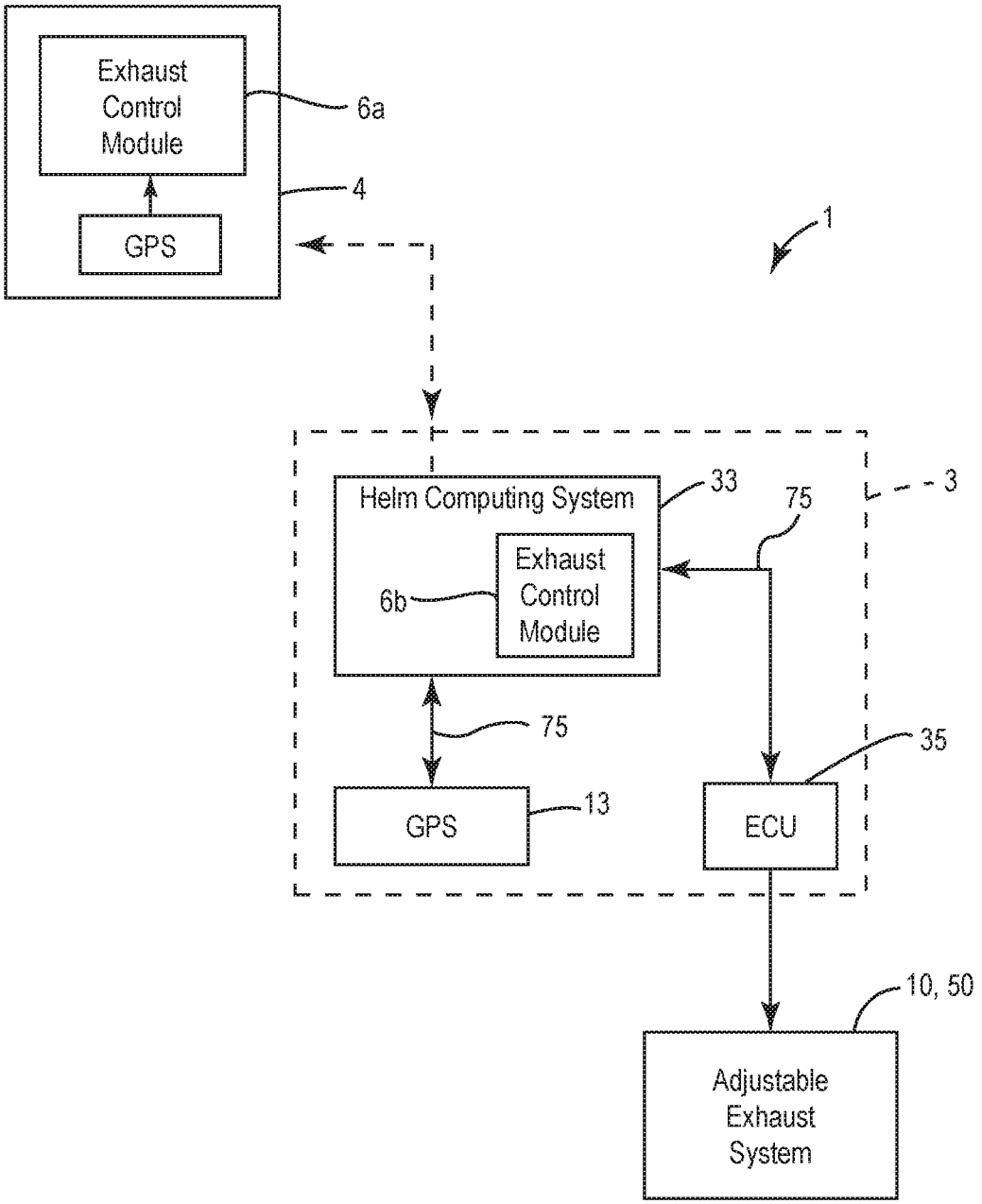
FIG. 1 is a schematic view of an exhaust system for a marine engine according to one embodiment of the present disclosure.

Through their research and development in the relevant field, the inventors have determined that noise requirements and expectations for noise may vary depending on geographical location and/or time of day, and that operator preference for the noise level of the exhaust system varies among vessel operators and for various boating applications. For example, performance boaters may desire a louder more aggressive sound quality for the exhaust system on the marine engine. However, such loud exhaust sound may not always be desirable or permissible in all boating environments. For example, certain marinas, inland lakes, or shore environments may have regulations in place that limit noise. Similarly, certain areas may have norms or follow good neighbor practices where boaters refrain from producing loud noises in certain areas and/or at certain times of day (such as during twilight and night hours).

Furthermore, the inventors have recognized during their research and development that boaters are often unaware of such noise regulations and/or expectations, and thus may unknowingly violate noise constraints by operating their adjustable exhaust system in a high noise-producing mode in violation of local noise constraints. Such behavior can lead to citations to the vessel operator and/or unexpected complaints about that vessel operator's behavior. Accordingly, the inventors have recognized that it is desirable to provide an exhaust system that incorporates control functionality based on geographical location and/or based on time of day and, in certain embodiments, automatically adjusts the mode of the exhaust system to reduce the noise level in order to comply with local noise constraints.

In certain embodiments, the exhaust control system and method are configured to determine whether the adjustable exhaust system is exceeding any noise constraint based on a current exhaust mode of the adjustable exhaust system and a geographical location of the marine vessel. A time of day may also be considered, in certain embodiments, in identifying applicable noise constraints and determining whether such noise constraint(s) is/are being exceeded by the exhaust system. For example, the control system may determine the exhaust mode and thus the amount of noise being produced (or an approximation thereof), based on a position of one or more valves within the adjustable exhaust system 10. In certain embodiments, the exhaust control system may automatically control the adjustable exhaust system to change the exhaust mode thereof based on vessel location and/or time of day in order to comply with noise constraints.

Noise constraints may be determined based on the GPS location of the marine vessel, such as whether the marine vessel is within a certain distance of a shoreline, marina, or other geographical location. In certain examples, geofencing may be used to set up regions of automatic exhaust control, where the adjustable exhaust system 10 is automatically controlled to minimize noise, or not to exceed a noise constraint, when the marine vessel is within a geofence (which also may consider time of day when determining the noise constraint). Other location-based techniques may be used as an alternative to or in addition to geofencing, such as storing a map of GPS locations and noise constraints, or other location-based logic for determining applicable noise constraints based on vessel location.

FIG. 1 depicts one embodiment of an exhaust system 1. In the example, the exhaust system 1 includes an adjustable exhaust system 10, such as the multi-stage exhaust system examples described herein having a first exhaust stage portion and a second exhaust stage portion and a bypass valve therebetween, and an onboard computing system 3. The onboard computing system 3 may include software for controlling the adjustable exhaust system, an exhaust control module **6*b*, which is configured to control the adjustable exhaust system 10 to control the noise production thereof. The example further includes an operator's mobile device 4 comprising an exhaust control module 6*a*** enabling wireless interaction with the adjustable exhaust system and/or remote control of the exhaust mode.

In the example depicted in FIG. 1, the operator mobile device 4 wirelessly communicates with the onboard computing system 3 in order to effectuate control of the adjustable exhaust system 10. In other embodiments, the exhaust control may be provided by the onboard computing system 3, alone, and the system 1 may not communicate with an operator mobile device. In still other embodiments, the operator mobile device 4 may communicate directly with a local controller for the adjustable exhaust system 10, which in the depicted embodiment is the engine control unit (ECU) 35.

In the depicted example, the onboard computing system 3 includes a helm computing system 33 having exhaust control software, the exhaust control module **6*b*, and thus is configured to control the adjustable exhaust system 10 based on vessel location and/or time of day. The helm computing system 33 is communicatively connected to a controller 35 (e.g., the ECU) that effectuates control instructions for the adjustable exhaust system 10. The helm computing system 33 is also communicatively connected to a location determination system, such as a global positioning system (GPS) 13 adapted for marine navigation. For example, the helm computing system 33 may be an onboard management system that manages engine data and control, steering data and control, as well as navigation. To provide just one example, the helm computing system 33 may be a VesselView® system provided by Mercury Marine of Fond du Lac, Wis. Correspondingly, the operator mobile device 4 may run corresponding mobile software application(s) that interact with onboard computing system 3** elements, such as VesselView Mobile® by Mercury Marine.

The elements of the onboard computing system 3 are communicatively connected via at least one communication link 75, which can be any wired or wireless network or means of inter-device communication. In particular, the helm computing system 33 communicates with the GPS 13 and/or the ECU 35 via one or more communications links 75, which may be a shared communication bus on which some or all of the components of the onboard computing system 3 communicate. For example, the communication link 75 may be a controller area network (CAN) bus, such as a CAN Kingdom Network. Alternatively, other types of wired or wireless networks may be utilized, such as a Wi-Fi-compliant wireless local area network (WLAN) or a communication network implementing a different RF communication protocol, such as Bluetooth, near field communication (NFC), ANT, or any other suitable protocol. Communication between the onboard computing system 3 and the operator's mobile device 4 may similarly be by any wireless means, such as Wi-Fi or Bluetooth. Additionally, the computing system 3 may be configured to communicate with the operator computing device 4 via a cellular network, thus enabling communication and control of the exhaust system by an operator located remotely from the marine vessel. The inventors have recognized that such remote monitoring may provide benefits to a marine vessel owner or manager to monitor use of the adjustable exhaust system 10 with respect to geographical locations, such as to monitor and/or force compliance with local noise constraints. For example, such remote monitoring may be employed by a boat club or boat rental situation where boat owners want to ensure that their vessels are operated in compliance with local noise restrictions.

Figure 3:
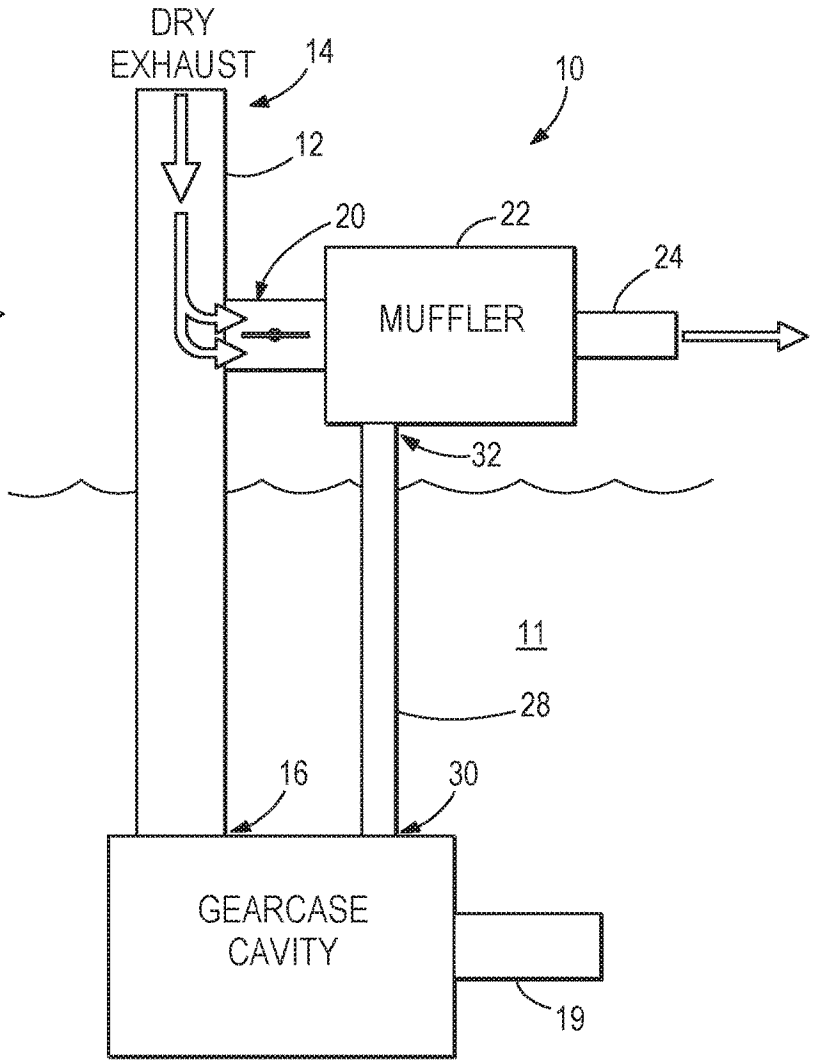
FIG. 3 is another schematic view of the adjustable exhaust system embodiment shown in FIG. 2.
Figure 2:
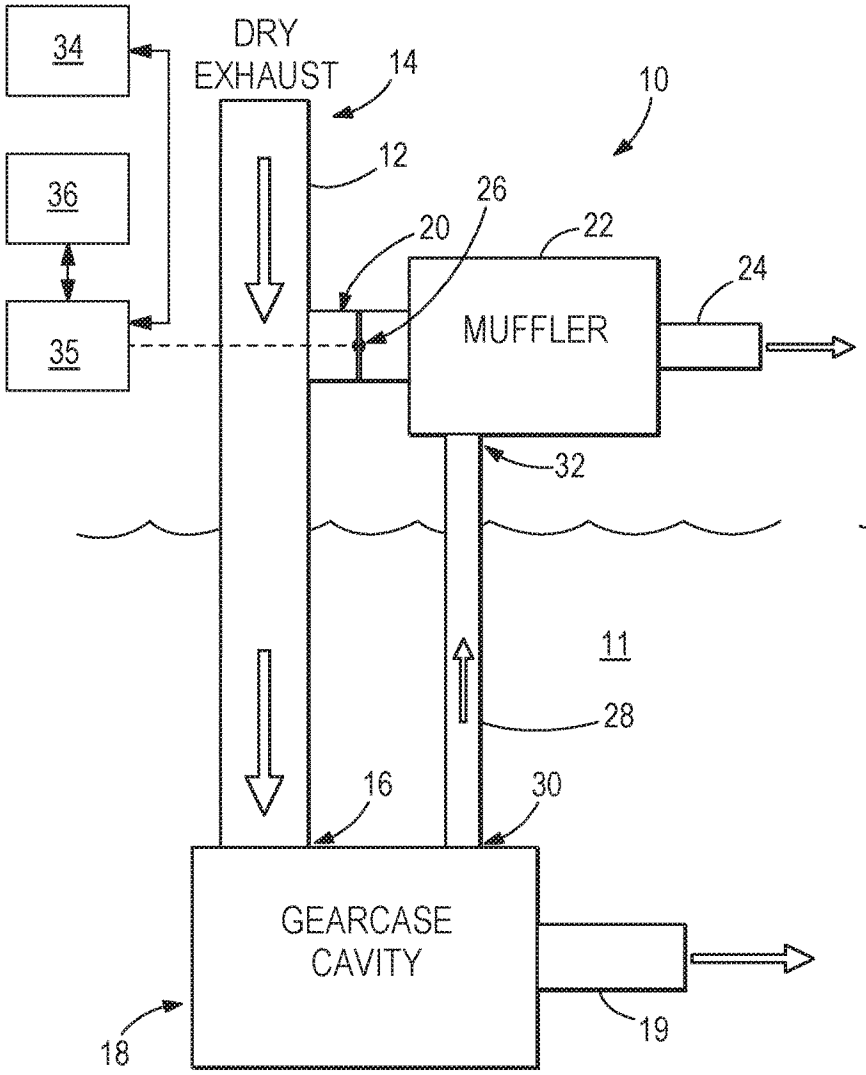
FIG. 2 is a schematic view of an exemplary adjustable exhaust system for a marine engine.

FIGS. 2-7 depict examples of adjustable exhaust systems that may be controlled in various modes to adjust the noise level produced and comply with local noise constraints. Referring to FIGS. 2 and 3, an exemplary adjustable exhaust system 10 is schematically depicted for use with a marine engine. The marine engine may, in various embodiments, be an outboard motor, a stern drive, an in-board drive, or any other type of marine drive having an internal combustion, many of which are known in the marine arts. As is conventional, the marine engine has an internal combustion engine (not shown) and is configured to propel a marine vessel in a body of water 11 according to known principles. FIGS. 2 and 3 are schematic in nature and do not depict the internal combustion engine; however internal combustion engines are well known in the art, examples of which being described in the above-referenced U.S. Patents. The exemplary adjustable exhaust system 10 includes a primary exhaust conduit 12 having an upstream end 14 that is configured to receive hot, dry exhaust gas from the noted internal combustion engine and a downstream end 16 that is configured to discharge the exhaust gas to the body of water 11 via a gearcase cavity 18 of the marine engine. The manner in which the exhaust gas is discharged from the gearcase cavity 18 can vary. In certain examples, the exhaust gas is discharged via a propeller housing outlet 19 that is located in the body of water 11 when the marine engine is in use. This is a conventional arrangement for discharging the exhaust gas from a marine engine and thus the propeller housing outlet 19 is schematically shown and is not further described herein.

An intermediate exhaust conduit 20 is coupled to the primary exhaust conduit 12 between the upstream end 14 and the downstream end 16. The intermediate exhaust conduit 20 receives the exhaust gas from the primary exhaust conduit 12. Optionally, a muffler (sometimes referred to in the art as an "idle relief muffler") 22 receives the exhaust gas from the intermediate exhaust conduit 20 and discharges the exhaust gas to an idle relief outlet 24, which typically is formed through a cowling of the marine engine. In other examples, the intermediate exhaust conduit 20 discharges the exhaust gas to the idle relief outlet 24 without passing through a muffler. In these examples, the intermediate exhaust conduit 20 and/or idle relief outlet 24 can form a tuned outlet duct that exits the cowl of the marine engine separately or through the idle relief outlet 24. The idle relief outlet 24 is configured to discharge the exhaust gas to atmosphere. More specifically, the idle relief outlet 24 is configured to be located above the body of water 11 in which the marine engine is operating, at least when the marine engine is operated at an idle speed.

According to the present disclosure, a bypass mechanism, such as a bypass valve 26, is coupled to and/or located in the intermediate exhaust conduit 20 between the primary exhaust conduit 12 and the idle relief outlet 24. The type of bypass valve 26 can vary and in certain examples can be a conventional mechanically-controlled valve and in other examples can be a conventional electrically-controlled valve. Various valve devices may be utilized, such as various rotary or linearly actuated valves, multiple embodiments of which are well known in the art. The bypass valve 26 is positionable into an open position, shown in FIG. 3, wherein the exhaust gas is permitted to flow through the intermediate exhaust conduit 20 from the primary exhaust conduit 12 to the muffler 22 and idle relief outlet 24. Thus, in the open position, at least a portion of the exhaust gas is allowed to bypass the downstream end 16 of the primary exhaust conduit 12 and bypass the gearcase cavity 18 and flow directly from the primary exhaust conduit 12 to the idle relief outlet 24 via the intermediate exhaust conduit 20 and optionally via the muffler 22. The bypass valve 26 is alternately positionable into a closed position, shown in FIG. 2, wherein the exhaust gas is substantially prevented from flowing through the intermediate exhaust conduit 20 from the primary exhaust conduit 12, and thus is not allowed to bypass the downstream end 16 of the primary exhaust conduit 12 and gearcase cavity 18. Instead the exhaust gas is forced to bypass most of or all of the intermediate exhaust conduit 20 and flow to the gearcase cavity 18 for subsequent discharge to the body of water via the propeller housing outlet 19 and/or to atmosphere via the muffler 22 and idle relief outlet 24, which are connected to the gearcase cavity 18 by a secondary exhaust conduit 28. The secondary exhaust conduit 28 has an upstream end 30 that is configured to receive the exhaust gas from the gearcase cavity 18 and a downstream end 32 that is configured to discharge the exhaust gas to the muffler 22, for subsequent discharge via the idle relief outlet 24.

In some examples, the bypass valve 26 can be positionable into one or more intermediate position(s) wherein, as compared to the noted open position, a reduced amount of the exhaust gas is permitted to bypass the downstream end 16 of the primary exhaust conduit 12 and gearcase cavity 18. In other words, when the bypass valve 26 is in the intermediate position(s), some of the exhaust gas is allowed to bypass the downstream end 16 of the primary exhaust conduit 12 and bypass the gearcase cavity 18 and flow directly from the primary exhaust conduit 12 to the idle relief outlet 24 via the intermediate exhaust conduit 20 and optionally the muffler 22. The remainder of the exhaust gas is forced to bypass most of or all of the intermediate exhaust conduit 20 and flow to the gearcase cavity 18 for subsequent discharge to the body of water via the propeller housing outlet 19 and/or to atmosphere via the muffler 22 and idle relief outlet 24, which are connected to the gearcase cavity 18 by a secondary exhaust conduit 28. This example provides the operator with additional active tunability of the sound emanating from the adjustable exhaust system 10.

In some examples, the adjustable exhaust system 10 can include an operator input device 34 that is mechanically and/or electrically and/or otherwise communicatively coupled to and configured to control the bypass valve 26. The operator input device 34 can be configured such that, via the operator input device 34, an operator can have the ability to selectively position the bypass valve 26 into and out of the open and closed positions, and optionally the intermediate position(s). The type and configuration of the operator input device 34 can vary and the manner in which the operator input device 34 is connected to the bypass valve 26 can vary. In one example, the operator input device may be provided by a user interface on the operator's mobile device 4 and/or the helm computing system 33. For example, the exhaust control module(s) 6*a*, 6*b* may interact with the user interface software for the respective device to prompt and receive user input to control the exhaust mode—e.g. position of the bypass valve 26. In other non-limiting examples, the operator input device 34 can include one or more mechanical levers, and/or computer keypads, and/or touch screens and/or the like. The operator input device 34 can be configured to directly communicate with and control the position of the operator input device 34 via for example a mechanical, or electronically wired or wireless communication link, an example of which is schematically shown in the drawings. In other examples, the operator input device 34 can be configured to communicate an operator input directly to the controller 35 configured to electronically control the bypass valve 26. In certain examples, a sensor may be associated with the bypass valve 26 to measure and provide feedback regarding the position of the bypass valve 26.

Optionally, the adjustable exhaust system 10 can include an indicator device 36 that is configured to indicate to the operator a current position of the bypass valve 26. The operator input device 34 and/or indicator device 36 can be located remotely from the marine engine, for example at the helm of the marine vessel, or even remotely from the marine vessel. The type of indicator device 36 can vary. In certain non-limiting examples, the indicator device 36 can include a video or touch screen, and/or flashing lights, and/or the like. For example, the indicator may be provided by the operator's mobile device 4 and/or the helm computing system running the exhaust control module 6*a*, 6*b*. The indicator device 36 can be electronically controlled by the controller 35 to indicate to the operator the current position of the bypass valve 26.

Via the operator input device 34, the exemplary system shown in FIGS. 2 and 3 advantageously provides the ability to actively control the quality and characteristics of exhaust sound emanating from the adjustable exhaust system 10. This capability can provide significant advantages in certain settings. For example performance and/or bass boaters can obtain a louder, more aggressive sound quality. Off-shore fisherman or recreational boaters can obtain a quieter, less aggressive sound quality. However, according to the present disclosure, the sound quality can be appropriately controlled based on localized noise constraints.

Effectively, these examples replace a traditional passively-controlled exhaust system for a marine engine with a multi-stage adjustable exhaust system 10 that can be actively controlled based on geographical location and user preference. The operator can select between through-cowl and through-prop exhaust modes, rather than relying on a passive pressure differential. Those preferences can then be honored as much as possible based on local restrictions automatically recognized by the system 1. The exhaust gas can be routed through a muffler 22 prior to exiting the idle relief outlet 24, creating an opportunity to refine the audible exhaust note. This allows the operator to select the sound quality "character" of their choosing, and to operate the system without concern of violating local noise constraints.

An additional advantage of the exhaust modes where back pressure is reduced (louder modes) is the potential to increase horsepower, as well as reduce risk for water reversion to the internal combustion engine by adding an exhaust circuit at a higher elevation (i.e. above the surface of the body of water 11) on the primary exhaust conduit 12.

Figure 5:
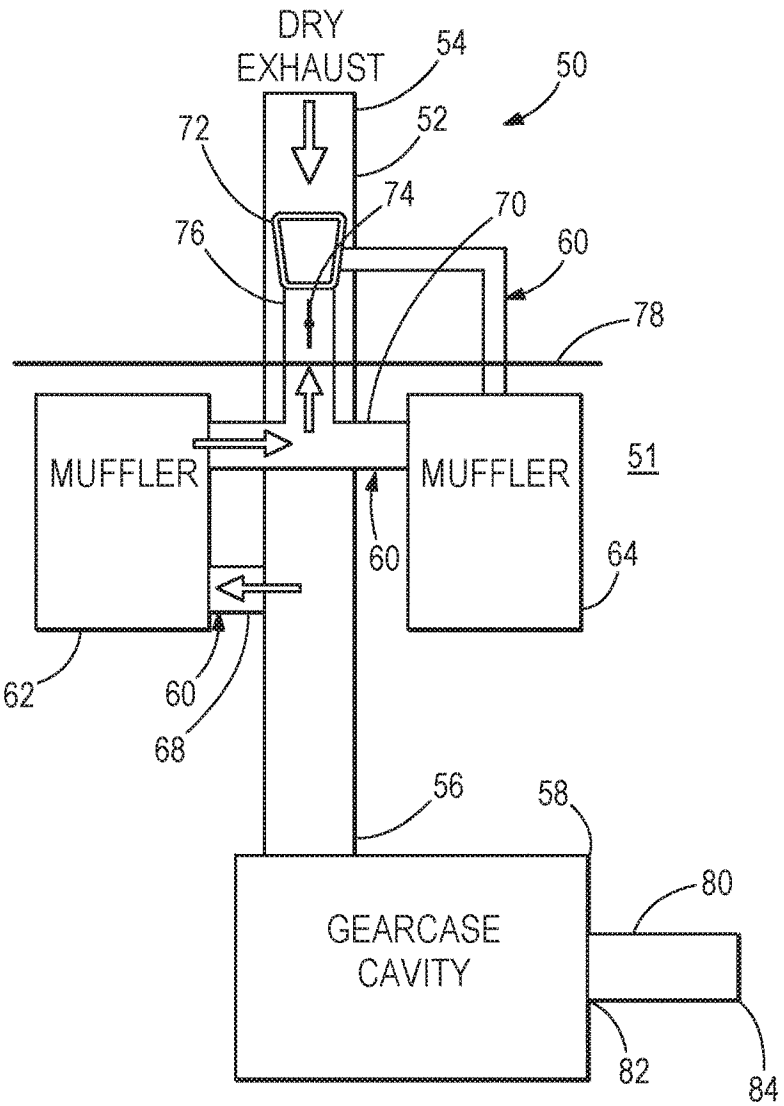
FIG. 5 is another schematic view of the adjustable exhaust system embodiment shown in FIG. 4.
Figure 4:
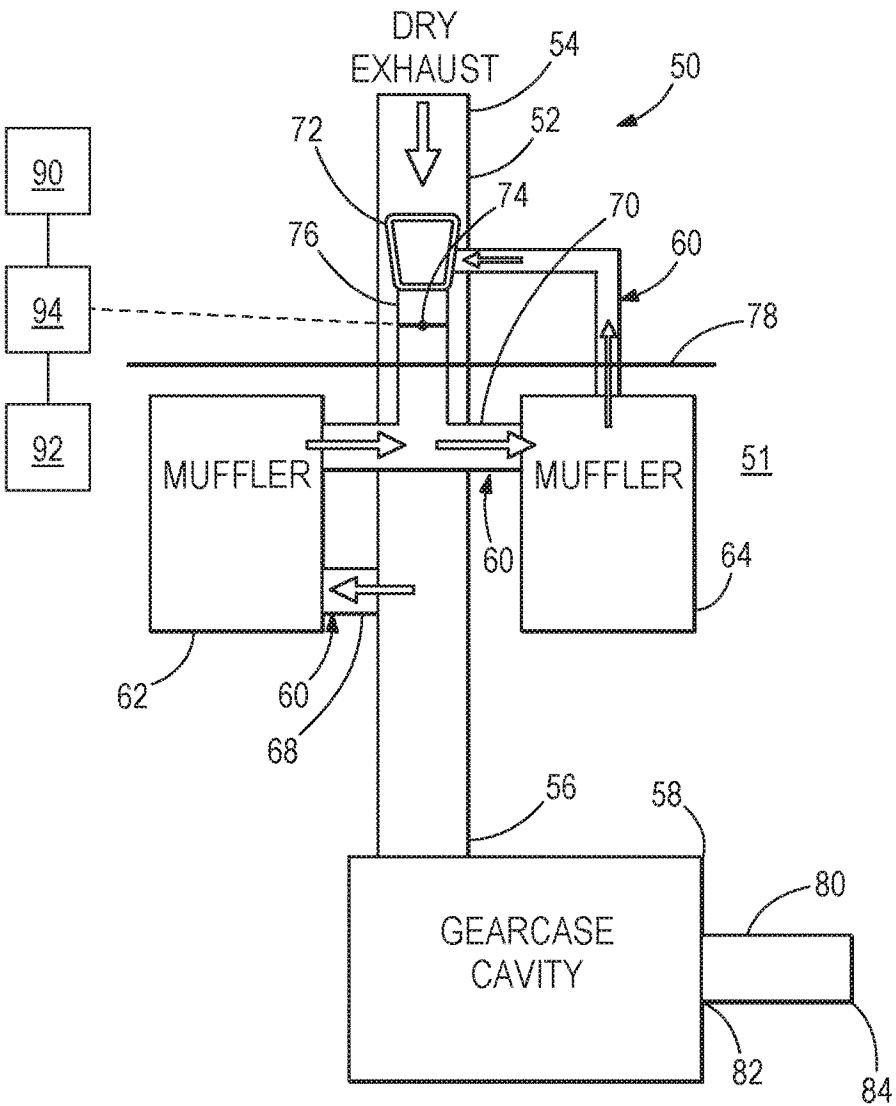
FIG. 4 is a schematic view of a second exemplary exhaust system for a marine engine.
Figure 6:
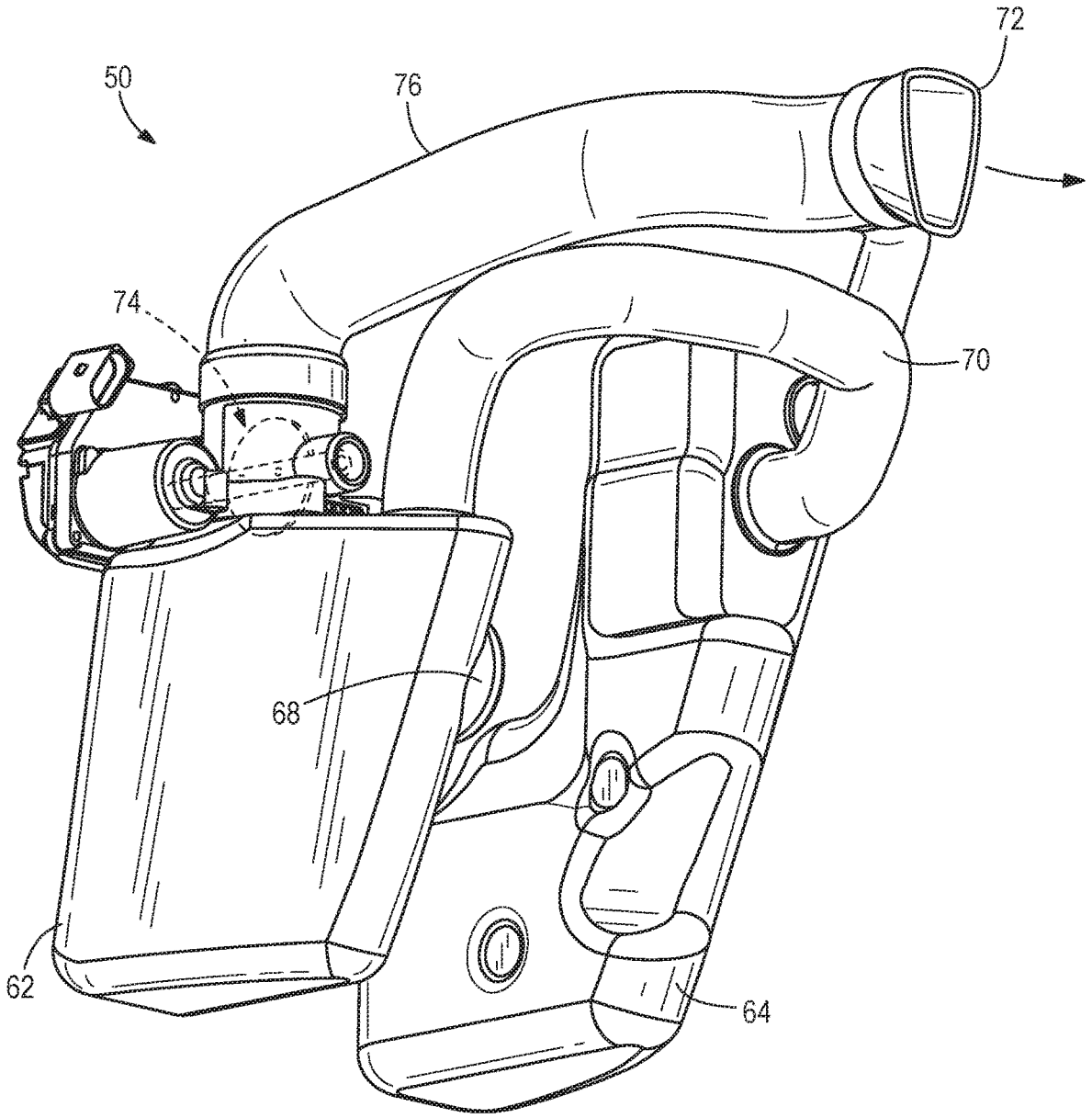
FIGS. 6 and 7 are front and rear perspective views of an exemplary exhaust system for a marine engine.
Figure 7:
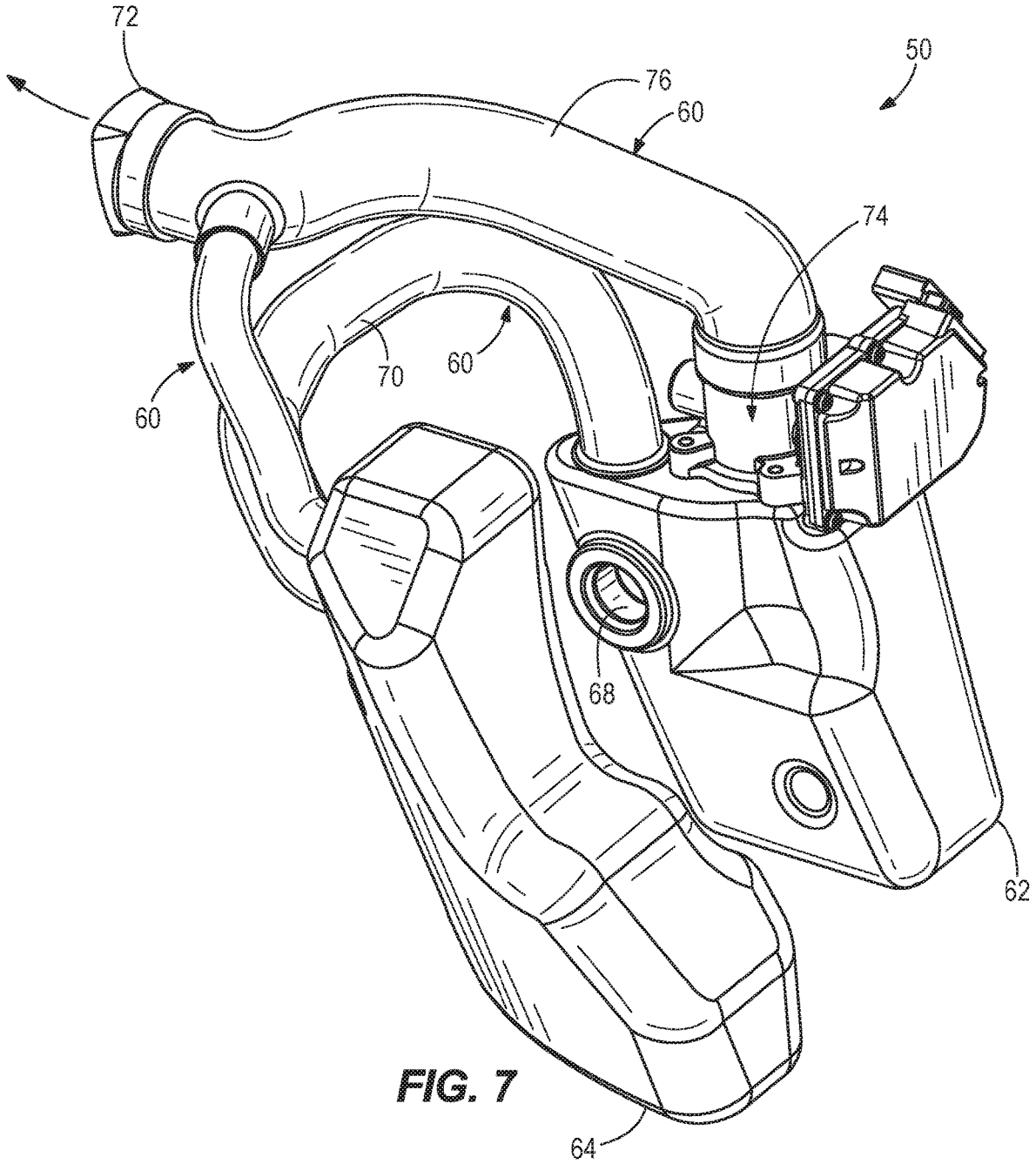

FIGS. 4-7 depict another example of an adjustable exhaust system 50 for a marine engine having an internal combustion engine and configured to propel a marine vessel in a body of water 51. FIGS. 4 and 5 are schematic views and FIGS. 6 and 7 are perspective views of certain components. The exemplary exhaust system 50 includes a primary exhaust conduit 52 having an upstream end 54 that is configured to receive exhaust gas from the noted internal combustion engine and a downstream end 56 that is configured to discharge the exhaust gas to a surrounding body of water 51 via a gearcase cavity 58 and via a secondary exhaust conduit 80. The secondary exhaust conduit 80 has an upstream end 82 configured to receive the exhaust gas from the gearcase cavity 58 and a downstream end 84 configured to discharge the exhaust gas to the body of water 51.

An intermediate exhaust conduit 60 is coupled to the primary exhaust conduit 52 between the upstream end 54 and downstream end 56 and is configured to receive the exhaust gas from the primary exhaust conduit 52. A primary muffler 62 receives the exhaust gas from the intermediate exhaust conduit 60. A secondary muffler 64 receives the exhaust gas from the primary muffler 62 via the intermediate exhaust conduit 60. The intermediate exhaust conduit 60 has an upstream end 68 that receives the exhaust gas from the primary muffler 62 and a first downstream outlet 70 that discharges the exhaust gas to the secondary muffler 64. The exhaust system 50 also includes an idle relief outlet 72 that discharges the exhaust gas from the secondary muffler 64 to atmosphere. The idle relief outlet 72 is configured to be located above the body of water in which the marine engine is operated, at least when the marine engine is operated at idle speed.

A bypass valve 74, or other bypass mechanism, is coupled to and/or positioned in the intermediate exhaust conduit 60 and is positionable into an open position, shown in FIG. 5, wherein the exhaust gas is permitted to bypass the secondary muffler 64 and flow from the primary muffler 62 to the idle relief outlet 72. The intermediate exhaust conduit 60 has a second downstream end 76 that discharges the exhaust gas to the idle relief outlet 72 when the bypass valve 74 is in the noted open position. The bypass valve 74 is further positionable into a closed position, shown in FIG. 4, wherein the exhaust gas is substantially not permitted to bypass the secondary muffler 64 via the second downstream end 76. Instead, the exhaust gas flows from the primary muffler 62 to the idle relief outlet 72 via the first downstream outlet 70 and secondary muffler 64.

In certain examples, the bypass valve 74 is also positionable into one or more intermediate position(s) wherein, compared to the open position, at an idle speed of the internal combustion engine, a reduced amount of exhaust gas is permitted to bypass the secondary muffler 64 and flow from the primary muffler 62 to the idle relief outlet 72. In other words, at an idle speed of the internal combustion engine, in the intermediate position(s) a portion of the exhaust gas is permitted to bypass the secondary muffler 64 and a portion of the exhaust gas is permitted to flow through the secondary muffler 64. Both portions are discharged from the marine engine via the idle relief outlet 72. In certain examples, the bypass valve 74 is located at the second downstream end 76 of the intermediate exhaust conduit 60, at a location that is on an opposite side of an adapter plate 78 of the marine engine relative to the primary and secondary mufflers 62, 64.

When the bypass valve 74 is in the closed position the exhaust system 50 forms a dual muffler circuit and when the bypass valve 74 is in the open position, the exhaust system includes a single muffler circuit. The exhaust system 50 operates in a "quiet mode" when the bypass valve 74 is in the closed position and the exhaust gas is routed through the more restrictive, increased-transmission-load, dual muffler circuit. The exhaust system 50 operates in a relatively louder "sport mode", when the bypass valve 74 is in the open position and the exhaust gas is routed through the less restrictive, decreased-transmission-load, single muffler circuit. The bypass valve 74, and thus the mode of the adjustable exhaust system 10, 50, can thus be controlled to comply with any noise constraints identified base don geographical location.

In certain examples, the exhaust system 50 includes an operator input device 90, an indicator device 92 and/or a computer controller 94, which can be constructed and function in the same manner as the operator input device 34, indicator device 36, and computer controller 35 described hereinabove with respect to FIGS. 2-3.

An advantage of the example shown in FIGS. 4-8 is that the bypass valve 74 is physically removed from potentially hot, dry exhaust gas in the primary exhaust conduit 52, which could otherwise potentially degrade the operational life of the valve. Instead, the bypass valve 74 is configured to control flow of cooled, wet exhaust gas typically found an idle relief circuit. Also, the bypass valve 74 can advantageously be located under the noted cowling for the internal combustion engine of an outbound marine drive, above the adapter plate 78 and in-line with the idle relief outlet. This lessens the potential damaging or degrading effects of exposure of the bypass valve 74 to the surrounding elements, such as water.

Figure 8:
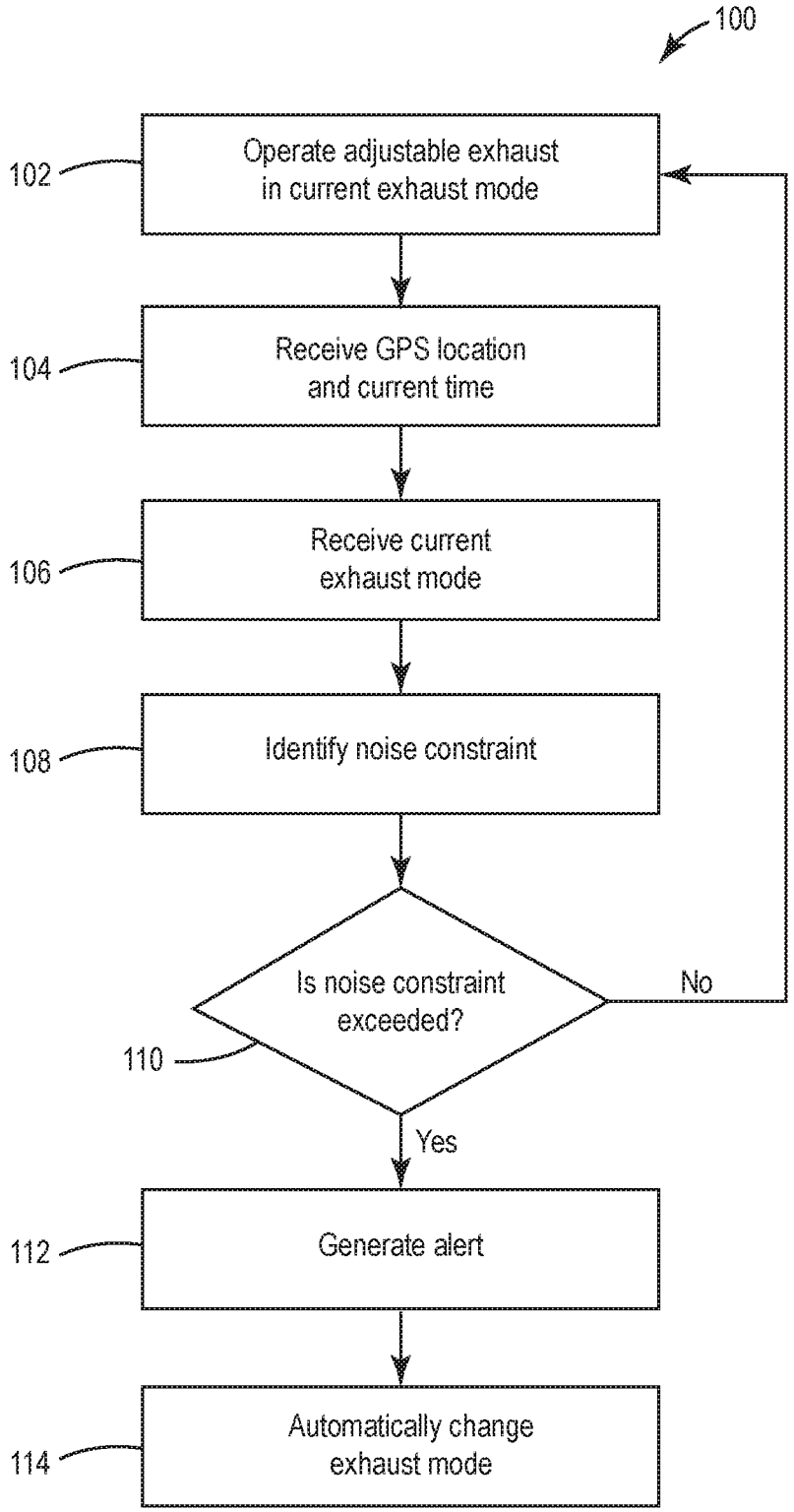
FIG. 8 is one embodiment of a method of controlling an adjustable exhaust system for a marine engine.

FIG. 8 depicts one embodiment of the method 100 for controlling an adjustable exhaust system where adjusting the exhaust modes controls noise level generated by the exhaust system, such as the exemplary adjustable exhaust systems 10, 50 described herein. For example, the depicted steps may be performed by executing software instructions comprising the exhaust control module 6 stored within, and executed on a processor of, the onboard computing system 3 and/or the operator mobile device 4. The adjustable exhaust system is operated in a current exhaust mode at step 102, such as according to a user input to set the exhaust mode 4 and established user preference (e.g., a user-set or default exhaust mode). Location data is received at step 104. For instance, the GPS coordinates may be provided by a GPS system 13 operating within the onboard computing system 3. Alternatively, if the exhaust control is being executed on the operator mobile device 4, the GPS coordinates may be provided by a GPS system local to the operator's mobile device 4, as is standard in most mobile phones and in many other types of mobile computing devices. The GPS system may also provide the current time, or the current time may be provided by a clock operating as part of the respective computing device 3, 4.

A current exhaust mode is identified at step 106, which may be received from a local controller for the exhaust system or may be stored within the computing system executing the exhaust control algorithm as the current exhaust mode for the adjustable exhaust system 10, 50. The current exhaust mode may be, for example, a position or position range for the bypass valve 26, 74, or may be another identification of the "mode" in which the adjustable exhaust system 10, 50 is operating. The noise level associated with that "mode" can then be determined. For example, a decibel level or other noise measurement may be associated with each mode of the adjustable exhaust system 10, 50. A person having ordinary skill in the art will understand in view of the present disclosure that the noise level may be identified in multiple ways in order to execute the disclosed mode, and that such various embodiments are within the scope of the present disclosure. For example, the noise level may be classified as simply "loud" or "quiet", or intermediate classifications may also be provided based on the number of modes for the respective adjustable exhaust system on the marine vessel.

The noise constraint is then identified in step 108 based on the GPS location and/or current time. In one embodiment, geofencing may be utilized to identify noise constraints based on geographical proximity to a predefined location, such as a coastline or marina. Alternatively to geofencing, other location-based analysis may be performed to identify noise constraints. For example, the exhaust control module 6*a*, 6*b* may access a map storing GPS or other location identifiers and corresponding noise constraints, such as local or regional map populated with noise constraints. In still other embodiments, analysis may be conducted to determine a distance from shore or distance from any predefined landmarks (marinas, residential areas, etc.) to determine whether a noise constraint applies. Alternatively or additionally, noise constraint analysis may involve assessment of the current time of day, where particular noise constraints may only apply during twilight and evening hours, for example. Alternatively or additionally, date and/or day restrictions may be applied, such as restrictions particular for certain days of weeks, seasons, holidays, etc.

The noise constraints may be dictated by, for example, local, national, or regional regulations. Alternatively or additionally, noise constraints may account for "good neighbor" practices, where noise constraints may be applied in highly populated or other noise-sensitive areas, which again may be specifically applied based on date and/or time of day. In various embodiments, a noise constraint may be configured and associatable with the current exhaust mode noise levels. For example, the noise constraint may be identified as a decibel level or by other means, such as the high/low noise level described above.

Instructions are then executed at step 110 to determine whether the local noise constraint is exceeded by the exhaust system based on the current exhaust mode. If the noise constraint is not exceeded, then the system continues its operation of the adjustable exhaust system in the current exhaust mode, such as the user-instructed mode. However, if the noise constraint is determined to be exceeded at step 110, then steps are executed to remediate violation of the local noise constraint.

An alert may be generated at step 112 to alert the operator of the local noise constraint and the fact that it is being violated by the adjustable exhaust system 10, 50 in the current exhaust mode. For example, the alert may be generated on the operator input device 34, 90, which again may be the user interface of the helm computing system 33 and/or the operator mobile device 4. Thus, in one embodiment, the operator may get an alert on their mobile device, such as a push notification or a text, or by some other way of communicating the message thereby. Alternatively or additionally, the helm computing system 33 may generate an alert, which may be an auditory alert, a visual alert, or a combination thereof. In one embodiment, the alert may instruct the operator to change the current exhaust mode in order to comply with the noise constraint.

Alternatively, as shown in the example of FIG. 8, the control system may be configured to automatically change the exhaust mode, step 114, in order to automatically operate the adjustable exhaust system 10, 50 in compliance with the local noise constraint. In such an embodiment, the adjustable exhaust system 10, 50 will be automatically controlled to honor the user-instructed exhaust mode unless doing so violates a local noise constraint, and such a modification to the user-set instruction will be automatically actuated. In certain embodiments, the adjustable exhaust system 10, 50 may be operated in the loudest possible mode that does not exceed either of a local noise constraint or a user-instructed mode setting.

Alternatively or additionally, an alert may be generated at step 112 and the control system may execute a waiting period prior to automatically changing the exhaust mode at step 114. Thereby, the operator can be provided a period of time to either override the system instruction to decrease the exhaust noise to comply with noise constraints, or to execute the exhaust mode change themselves by inputting, e.g., via an operator input device 34, 90, and instructions to change the current exhaust mode.

In the present description, certain terms have been used for brevity, clarity, and understanding. No unnecessary limitations are to be inferred therefrom beyond the requirement of the prior art because such terms are used for descriptive purposes only and are intended to be broadly construed.

What is claimed is:

1. A method of controlling an adjustable exhaust system for a marine engine, the method comprising:

receiving a vessel location of a marine vessel having an adjustable exhaust system;

identifying noise constraint based on the vessel location, wherein the vessel location includes a GPS coordinate location and wherein identifying the noise constraint based on vessel location includes accessing a schedule of noise constraints based on GPS coordinates;

identifying a current exhaust mode of the adjustable exhaust system;

determining that the adjustable exhaust system is exceeding the noise constraint based on the current exhaust mode; and generating an instruction to adjust the adjustable exhaust system to reduce the noise generated thereby.

2. The method of claim 1, wherein identifying the noise constraint based on vessel location includes determining a current distance from shore.

3. The method of claim 1, wherein the vessel location includes a GPS coordinate location, and wherein identifying the noise constraint based on vessel location includes determining whether the marine vessel is within a geofence defined with respect to a geographic location.

4. The method of claim 3, wherein the geographic location includes at least one of a shoreline location or a marina location.

5. The method of claim 1, further comprising identifying a current time and further determining the noise constraint based on the current time.

6. The method of claim 1, wherein generating the instruction to change the exhaust mode includes generating an alert instructing an operator to change the exhaust mode of the adjustable exhaust system.

7. The method of claim 1, further comprising generating an alert at an operator's mobile device via an application when the adjustable exhaust system exceeds the noise constraint.

8. An exhaust system for a marine engine on a marine vessel, the adjustable exhaust system comprising:

an adjustable exhaust system having a first exhaust stage portion and a second exhaust stage portion, and a bypass valve that controls flow of exhaust gas between the first exhaust stage portion and a second exhaust stage portion;

an exhaust control module executable on a processor to:

receive a vessel location of the marine vessel from a location tracking system;

identify noise constraint based on the vessel location;

identify a current exhaust mode of the adjustable exhaust system;

determine that the adjustable exhaust system is exceeding the noise constraint based on the current exhaust mode; and generate an instruction to adjust the adjustable exhaust system to reduce the noise generated thereby, wherein generating the instruction to change the exhaust mode includes generating an alert instructing an operator to change the exhaust mode of the adjustable exhaust system, wherein the exhaust control module controls the bypass valve based on a user input provided at an operator input device.

9. The system of claim 8, wherein the exhaust control module is an application executable on an operator's mobile device, and wherein the system further comprises:

an onboard computing system that receives the instruction to adjust the bypass valve and controls the position of the bypass valve accordingly.

10. The system of claim 8, wherein the exhaust control module is an application executable on an onboard computing system that controls the position of the bypass valve.

11. The system of claim 8, wherein generating the instruction to adjust the adjustable exhaust system includes automatically controlling the bypass valve based on the noise constraint.

12. The system of claim 8, wherein the vessel location includes a GPS coordinate location, and wherein identifying the noise constraint based on vessel location includes determining whether the marine vessel is within a geofence defined with respect to a geographic location.

13. A method of controlling an adjustable exhaust system for a marine engine, the method comprising:

receiving a vessel location of a marine vessel having an adjustable exhaust system;

identifying noise constraint based on the vessel location;

identifying a current exhaust mode of the adjustable exhaust system;

determining that the adjustable exhaust system is exceeding the noise constraint based on the current exhaust mode; and generating an instruction to adjust the adjustable exhaust system to reduce the noise generated thereby, including generating an alert instructing an operator to change the exhaust mode of the adjustable exhaust system.

14. The method of claim 13, wherein the alert is generated on the operator's mobile device via an application thereon, and further comprising:

receiving user input instruction provided at the operator's mobile device to adjust the adjustable exhaust system; and automatically controlling the adjustable exhaust system based on the user input.

15. A method of controlling an adjustable exhaust system for a marine engine, the method comprising:

receiving a vessel location of a marine vessel having an adjustable exhaust system;

identifying noise constraint based on the vessel location;

identifying a current exhaust mode of the adjustable exhaust system;

determining that the adjustable exhaust system is exceeding the noise constraint based on the current exhaust mode;

generating an alert at an operator's mobile device via an application when the adjustable exhaust system exceed the noise constraint; and generating an instruction to adjust the adjustable exhaust system to reduce the noise generated thereby.

16. The method of claim 15, wherein identifying the current exhaust mode includes determining a position of a bypass valve in the adjustable exhaust system, and wherein generating the instruction to adjust the adjustable exhaust system includes automatically controlling the bypass valve based on the noise constraint.

17. The method of claim 15, wherein the alert is provided to the operator's mobile device for a primary operator, regardless of whether the operator's mobile device is on the marine vessel.

18. The method of claim 17, further comprising receiving a user instruction generated by the primary operator's mobile device to control the bypass valve of the adjustable exhaust system, wherein the control instruction is generated from the primary operator's mobile device when the operator is not on the marine vessel.

19. An exhaust system for a marine engine on a marine vessel, the adjustable exhaust system comprising:

an adjustable exhaust system having a first exhaust stage portion and a second exhaust stage portion, and a bypass valve that controls flow of exhaust gas between the first exhaust stage portion and a second exhaust stage portion;

an exhaust control module executable on a processor to:

receive a vessel location of the marine vessel from a location tracking system, wherein the vessel location includes a GPS coordinate location;

identify noise constraint based on the vessel location, and wherein identifying the noise constraint based on vessel location includes accessing a schedule of noise constraints based on GPS coordinates;

identify a current exhaust mode of the adjustable exhaust system;

determine that the adjustable exhaust system is exceeding the noise constraint based on the current exhaust mode; and generate an instruction to adjust the adjustable exhaust system to reduce the noise generated thereby.

20. The system of claim 19, wherein the exhaust control module is further configured to identify a current time and determine the noise constraint based on the current time.

* * * * *